US008170434B2

(12) United States Patent
Hong

(10) Patent No.: US 8,170,434 B2
(45) Date of Patent: May 1, 2012

(54) POWER ADAPTING APPARATUS WITH AN IMAGE FORMING APPARATUS AND ELECTRONIC APPARATUS HAVING THE SAME

(75) Inventor: Hyung-won Hong, Gangnam-gu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/490,430

(22) Filed: Jun. 24, 2009

(65) Prior Publication Data

US 2010/0034546 A1 Feb. 11, 2010

(30) Foreign Application Priority Data

Aug. 6, 2008 (KR) ..... 2008-77025

(51) Int. Cl.
*G03G 15/20* (2006.01)
*G03G 15/00* (2006.01)

(52) U.S. Cl. ..... 399/67; 399/88

(58) Field of Classification Search ..... 399/67, 399/88, 90
See application file for complete search history.

(56) References Cited

U.S. PATENT DOCUMENTS 7,313,341 B2 * 12/2007 Matsusaka ..... 399/88
7,783,223 B2 * 8/2010 Takahashi et al. ..... 399/88

* cited by examiner

*Primary Examiner* — Hoang Ngo
(74) *Attorney, Agent, or Firm* — Stanzione & Kim, LLP

(57) ABSTRACT

Disclosed are embodiments of a power adapting apparatus with an image forming apparatus and an electronic apparatus having the same. The power adapting apparatus includes a DC power generator to receive input AC power and generating DC power, a DC power output terminal to output the DC power, and an AC power output terminal to output the input AC power, wherein the power adapting apparatus is located outside an image forming apparatus receiving the DC power and the AC power respectively output from the DC power output terminal and the AC power output terminal.
According to the disclosed power adapting apparatus, the power adapting apparatus, the fusing controller, the protection circuit, the AC-AC transformer, and other extensible circuits can be arranged outside the image forming apparatus, and thus allowing for a reduction in size of the image forming apparatus. Accordingly, it is possible to produce compact printers or multi-function peripherals for SOHO (Small Office Home Office) and personal users, which satisfy consumer's demands.

21 Claims, 4 Drawing Sheets

POWER ADAPTING APPARATUS WITH AN IMAGE FORMING APPARATUS AND ELECTRONIC APPARATUS HAVING THE SAME

CROSS-REFERENCE TO RELATED APPLICATIONS

This application claims the benefit of Korean Patent Application No. 10-2008-0077025, filed on Aug. 6, 2008, in the Korean Intellectual Property Office, the disclosure of which is incorporated herein in its entirety by reference.

BACKGROUND OF THE INVENTION

1. Field of the Invention

The present general inventive concept relates to a power adapting apparatus including an alternating current (AC) output terminal capable of outputting AC power and direct current (DC) power, and an image forming apparatus and an electronic apparatus having the same.

2. Description of the Related Art

Development of compact printers for personal users is required. An apparatus using low DC power, such as a monitor, uses an external adapter having a switching mode power supply (SMPS) separatively attached to the apparatus, and thus the size of the apparatus can be reduced and the apparatus can be located more freely due to the adapter being external.

Laser printers and multi-function peripherals use AC power because they need a high temperature for printing. Accordingly, laser printers and multi-function peripherals do not use an adapter for converting AC power to DC power and include a power supply unit therein, thus creating limitations with regard to reducing the size of the printers or multi-function peripherals.

SUMMARY OF THE INVENTION

The present general inventive concept provides a power adapting apparatus which is located outside an image forming apparatus and can simultaneously output AC power and DC power.

The present general inventive concept also provides an image forming apparatus having the power adapting apparatus.

The present general inventive concept also provides an electronic apparatus having the power adapting apparatus.

Additional features and utilities of the present general inventive concept will be set forth in part in the description which follows and, in part, will be obvious from the description, or may be learned by practice of the general inventive concept.

Embodiments of the present general inventive concept provide a power adapting apparatus including a DC power generator to receive input AC power and to generate DC power, a DC power output terminal to output the DC power, and an AC power output terminal to output the input AC power, wherein the power adapting apparatus is located outside an image forming apparatus to receive the DC power and the AC power output respectively from the DC power output terminal and the AC power output terminal.

Embodiments of the present general inventive concept also provide an image forming apparatus including a main unit to receive AC power and DC power to perform an image forming operation and a power adapting apparatus comprising a DC power generator to receive input AC power and to generate DC power, a DC power output terminal to output the DC power and an AC power output terminal outputting the input AC power, wherein the power adapting apparatus supplies the AC power and the DC power to the main unit of the image forming apparatus.

Embodiments of the present general inventive concept also provide an electronic apparatus including a main unit to receive AC power and DC power and a power adapting apparatus comprising a DC power generator to receive input AC power and to generate DC power, a DC power output terminal to output the DC power and an AC power output terminal to output the input AC power, wherein the power adapting apparatus supplies the AC power and the DC power to the main unit of the electronic apparatus Embodiments of the present general inventive concept also provide an electronic apparatus comprising: an image forming unit to receive AC power and DC power; and an external power adapting unit with a switching mode power supply to convert received AC power to DC power and to output AC power upon receipt of a control signal from a fusing controller while providing DC power also output to the image forming unit.

Embodiments of the present general inventive concept also provide a method of reducing the size of an electronic apparatus, the method comprising: inputting AC power into a power source externally connected to a central unit of the electronic apparatus; converting AC power into DC power within the power source; and outputting AC power upon receipt of a control signal from a fusing controller while providing DC power output also from the power source into the central unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings, in which.

DETAILED DESCRIPTION OF THE PREFERRED EMBODIMENTS

Figure 1:
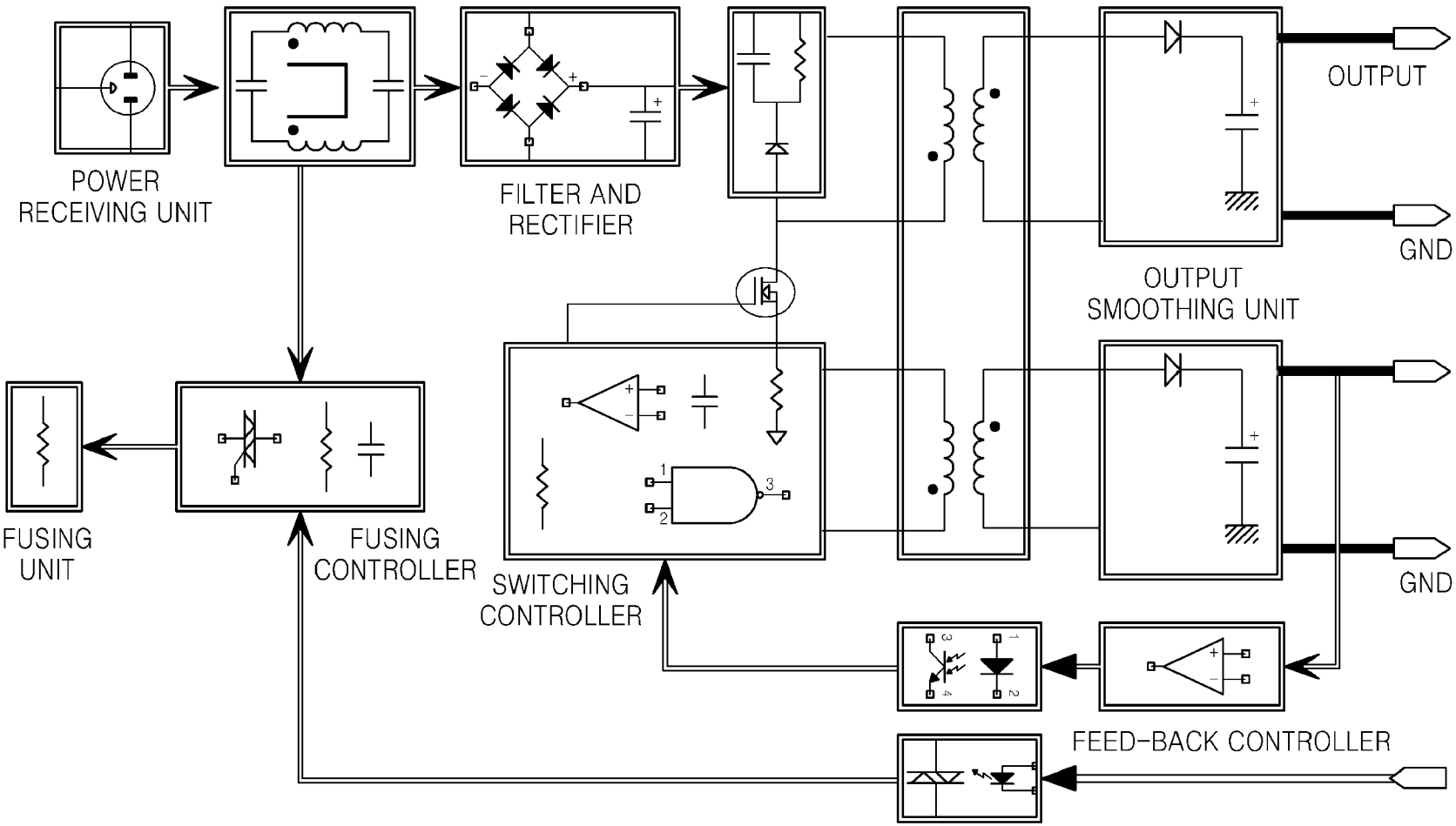
FIG. 1 is a schematic diagram illustrating a power supply unit of a general laser printer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic diagram illustrating a power supply unit of a general laser printer. Referring to FIG. 1, the power supply unit of the laser printer includes a fusing controller. A fusing unit of the laser printer is an AC load, and thus the fusing controller receives an ON/OFF control signal from a controller of the laser printer in order to control the fusing unit. The fusing controller may include a photo-triac and a triac enabling direct ON/OFF.

Figure 2:
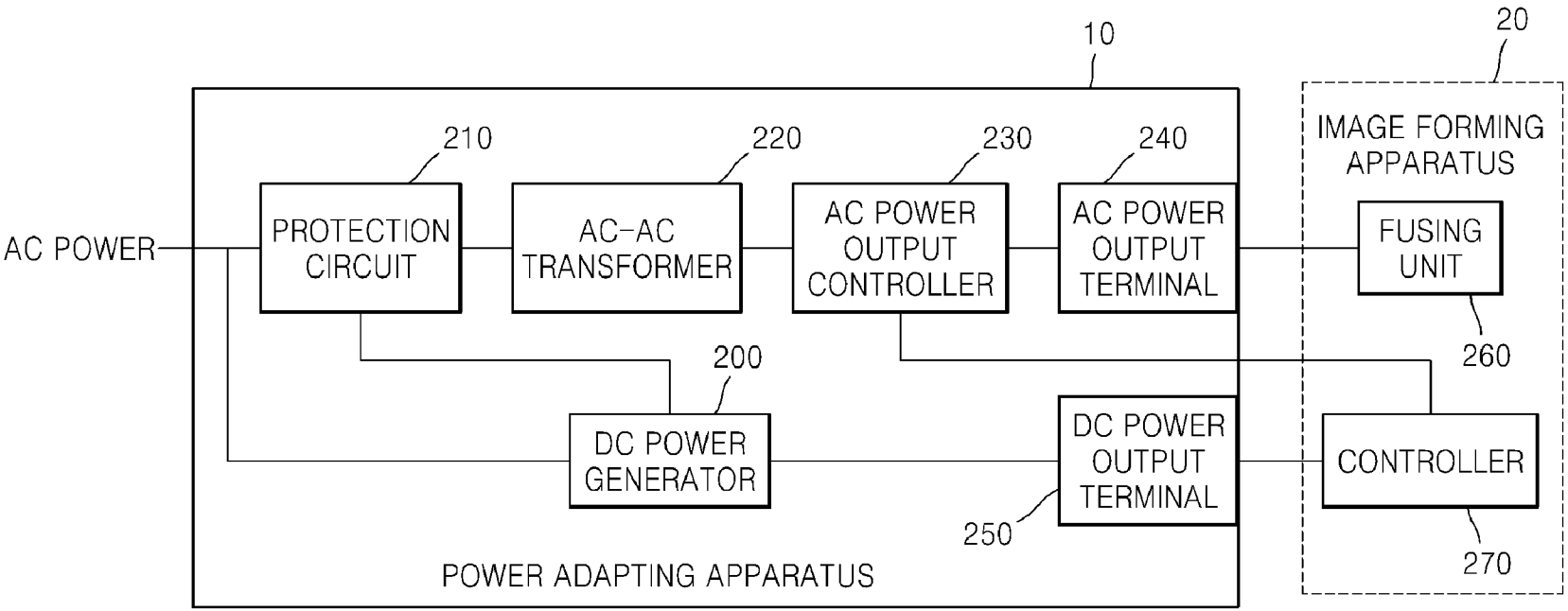
FIG. 2 is a block diagram of a power adapting apparatus including an AC power output terminal according to an exemplary embodiment of the present general inventive concept.

FIG. 2 is a block diagram of a power adapting apparatus 10 including an AC power output terminal according to an embodiment of the present general inventive concept. The power adapting apparatus 10 may be located outside an image forming apparatus 20.

The power adapting apparatus 10 according to the present embodiment of the present general inventive concept may include a DC power generator 200, an AC power output terminal 240, and a DC power output terminal 250. The power adapting apparatus 10 can further include at least one of a protection circuit 210, an AC-AC transformer 220, and an AC power output controller 230.

The DC power generator 200 can receive AC power and generate DC power and can use a general SMPS.

The DC power output terminal 250 can output the DC power generated by the DC power generator 200 and the AC power output terminal 240 can output the AC power. The power adapting apparatus 10 according to the present embodiment of the present general inventive concept can further include the protection circuit 210. The protection circuit 210 can block the AC power input to the power adapting apparatus 10 from outputting to the AC power output terminal 240 when the AC power is abnormal, for example, when over-current flows. The protection circuit 210 can use a relay and be located in the image forming apparatus 20. The power adapting apparatus 10 may not use the protection circuit 210.

The power adapting apparatus 10 according to the present embodiment of the present general inventive concept can further include the AC power output controller 230. The AC power output controller 230 can control output of the AC power from the protection circuit 210. The AC power output controller 230 can directly receive the AC power input to the power adapting apparatus 10 and control the output of the AC power when the power adapting apparatus 10 does not include the protection circuit 210. The AC power output controller 230 can be a fusing controller when applied to the image forming apparatus 20. The fusing controller can receive the AC power output from the protection circuit 210 as input power and control a fusing unit 260 of the image forming apparatus 20.

Figure 3:
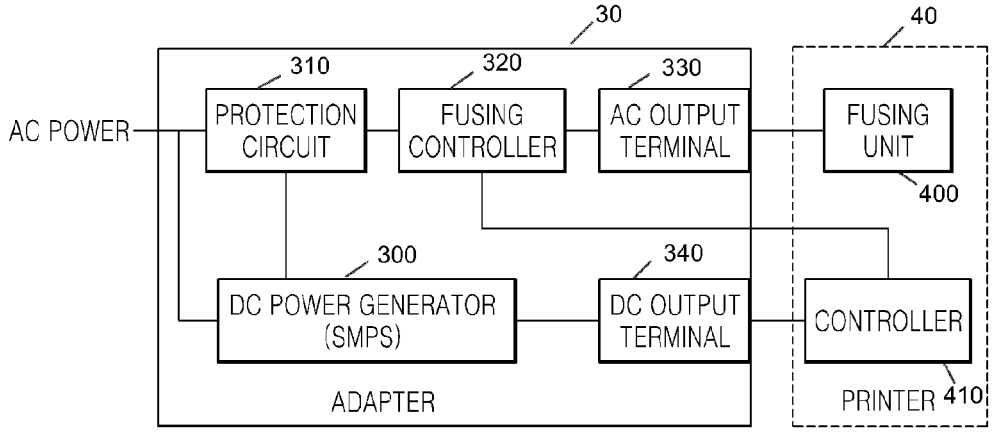
FIG. 3 is a block diagram of a power adapting apparatus according to another exemplary embodiment of the present general inventive concept.

FIG. 3 is a block diagram of a power adapting apparatus according to another exemplary embodiment of the present general inventive concept. Referring to FIG. 3, an adapter 30 corresponding to the power adapting apparatus can include a protection circuit 310 and a fusing controller 320. The protection circuit 310 can be located in an image forming apparatus or omitted.

Figure 4:
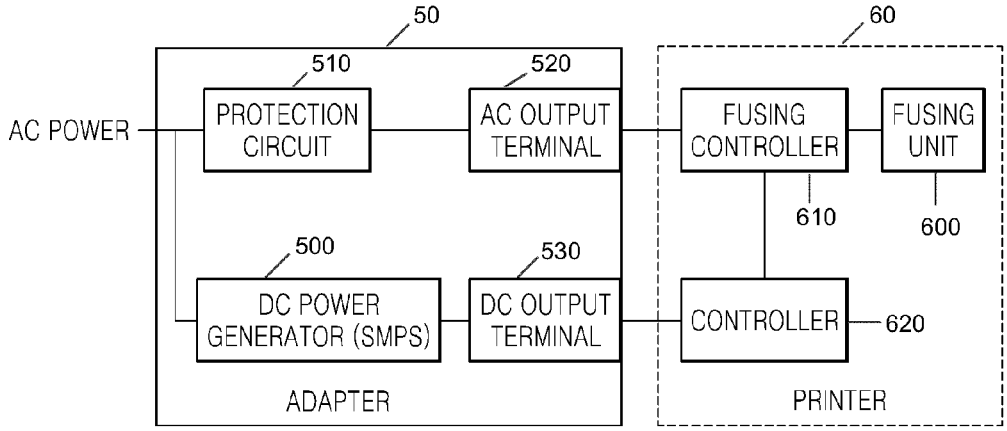
FIG. 4 is a block diagram of a power adapting apparatus according to another exemplary embodiment of the present general inventive concept.

FIG. 4 is a block diagram of a power adapting apparatus according to yet another exemplary embodiment of the present general inventive concept. An adapter 50 corresponding to the power adapting apparatus can include only a protection circuit 510, and a fusing controller 610 may be located in a printer 60 corresponding to an image forming apparatus. The protection circuit 510 can be located in the image forming apparatus or omitted as in the exemplary embodiment of FIG. 3.

Referring back to FIG. 2, the power adapting apparatus 10 according to the present embodiment of the present general inventive concept can further include the AC-AC transformer 220. The AC-AC transformer 220 can transform the voltage or current of the input AC power to the voltage or current of the output AC power when the voltage or current of the input AC power is different from the voltage or current of AC power required by the AC power output terminal 240. The AC-AC transformer 220 can output the input AC power without changing the voltage or current thereof when the voltage or current of the input AC power equals the voltage or current of the output AC power. That is, the power adapting apparatus 10 can be used for both input voltages of 110V and 220V and supply fixed AC power to the fusing unit 260 of the image forming apparatus 20 irrespective of the input AC voltage using the AC-AC transformer 220. For example, the AC-AC transformer 220 can transform 110V to 220V when 110V is applied to the power adapting apparatus 10 and can output 220V to the AC power output terminal 240 when 220V is applied to the power adapting apparatus 10 to provide 220V to the fusing unit 260 of the image forming apparatus 20. Thus the fusing unit 260 optimized to 220V can be used. While currently used DC output adapters are manufactured such that the adapters are suited to a universal input, adapters for laser printers should supply AC power adapted to fusing units of the laser printers. Accordingly, a supply of fixed AC power facilitates usage of image forming apparatuses and can enable standardization of adapters. The AC-AC transformer 220 can be located before or after the protection circuit 210.

Figure 5:
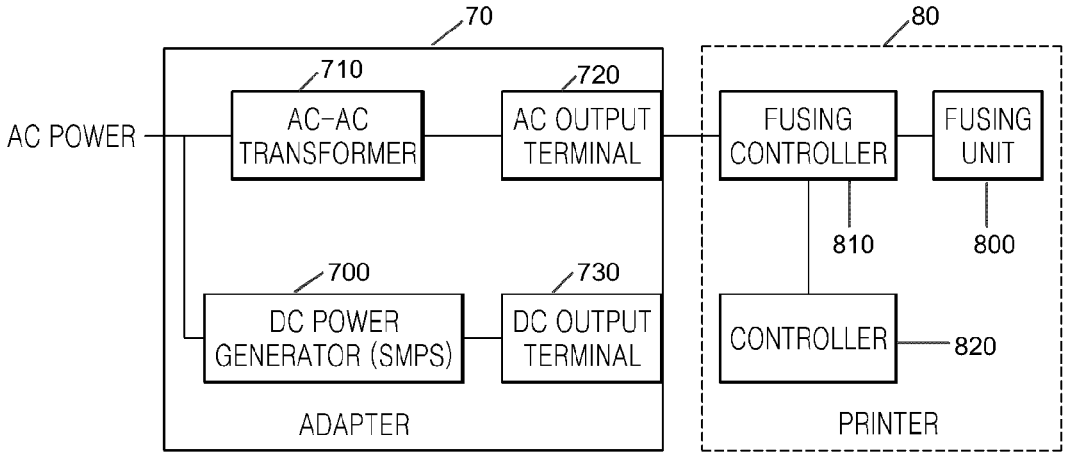
FIG. 5 is a block diagram of a power adapting apparatus according to another exemplary embodiment of the present general inventive concept.

FIG. 5 is a block diagram of a power adapting apparatus according to another exemplary embodiment of the present general inventive concept, and illustrates an adapter 70 corresponding to a power adapting apparatus available for a universal input, that is, for 110V/220V.

Meantime, the power adapting apparatus 10 according to the present general inventive concept can supply DC power and AC power to the main unit of the image forming apparatus 20. Furthermore, the present general inventive concept comprises of components including the power adapting apparatus 10 and the main unit of the image forming apparatus 20, which is separated from the power adapting apparatus 10.

The image forming apparatus 20 can further include at least one of the protection circuit 210, the fusing controller, and the AC-AC transformer 220. Furthermore, the power adapting apparatus 10, which receives AC power from an external device, can supply DC power and AC power to a main unit of an electronic apparatus. Accordingly, components of the present general inventive concept comprise the electronic apparatus which includes the main unit and the power adapting apparatus 10. The electronic apparatus can further include at least one of the protection circuit 210, the AC power output controller 230, and the AC-AC transformer 220.

While the electronic apparatus can include an electronic apparatus that receives AC power, for example, an electric heating instrument, a heater, or a cooking instrument, the electronic apparatus is not limited thereto.

According to the power adapting apparatus 10 according to the exemplary embodiments of the present general inventive concept, the power adapting apparatus 10, the fusing controller, the protection circuit 210, the AC-AC transformer 220, and other extensible circuits can be arranged outside the image forming apparatus 20, and thus the size of the image forming apparatus 20 can be remarkably reduced. Accordingly, it is possible to produce compact printers or multi-function peripherals for SOHO (Small Office Home Office) and personal users, which satisfy consumer's demands.

Furthermore, the power adapting apparatus 10 may be configured in the form of an adapter, and thus the power adapting apparatus 10 and the image forming apparatus 20 using the power adapting apparatus 10 can respectively acquire a safety standard. Accordingly, if the power adapting apparatus 10 is standardized, only the safety standard for the image forming apparatus 20 is required when the image forming apparatus 20 is newly developed, and thus the cost required to acquire the safety standard is decreased. Moreover, the image forming apparatus 20 can use a low-grade insulating material because the image forming apparatus 20 does not include the power adapting apparatus 10. That is, it is possible to decrease the safety standard acquisition cost and change the exterior material of the image forming apparatus 20 to reduce the development cost and manufacturing cost of the image forming apparatus 20. In addition, a power circuit can be standardized to remarkably reduce mass production cost. Furthermore, the power adapting apparatus 10 can be used for an electronic product that requires AC power from a source separated from the electronic product; thus allowing for a reduction in size of the electronic product.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A power adapting apparatus comprising:

a DC power generator to receive input AC power and to generate DC power;

a DC power output terminal to output the DC power;

an AC power output terminal to output the input AC power; and a protection circuit to block the input AC power from outputting to the AC power output terminal when the input AC power is abnormal, wherein the power adapting apparatus is spaced apart from an image forming apparatus that receives the DC power and the AC power output respectively from the DC power output terminal and the AC power output terminal, and wherein AC power received by the DC power generator bypasses the protection circuit.

2. The power adapting apparatus of claim 1, further comprising:

an AC power output controller to control output of the AC power from the protection circuit.

3. The power adapting apparatus of claim 2, wherein the AC power output controller is a fusing controller to control a fusing unit of the image forming apparatus using the AC power output from the protection circuit.

4. A power adapting apparatus comprising:

a DC power generator to receive input AC power and to generate DC power;

a fusing controller to control a fusing unit of an image forming apparatus using the input AC power;

a DC output terminal to output the DC power; and an AC power output terminal to output the input AC power controlled by the fusing controller, wherein the power adapting apparatus is spaced apart from the image forming apparatus that receives the DC power and the AC power output respectively from the DC power output terminal and the AC power output terminal.

5. The power adapting apparatus of claim 1, further comprising:

an AC-AC transformer to transform the voltage of the input AC power to the voltage of the AC power output through the AC power output terminal when the voltage of the input AC power is different from the voltage of AC power required by the AC power output terminal and outputs the input AC power without changing the voltage thereof when the voltage of the input AC power equals the voltage of the AC power output through the AC power output terminal.

6. The power adapting apparatus of claim 5, wherein the AC-AC transformer is positioned before a protection circuit.

7. An image forming apparatus comprising:

a main unit to receive AC power and DC power to perform an image forming operation; and a power adapting apparatus spaced apart from the main unit comprising a DC power generator to receive input AC power and to generate DC power, a DC power output terminal to output the DC power, an AC power output terminal to output the input AC power and a protection circuit to block the input AC power from outputting to the AC power output terminal when the input AC power is abnormal, wherein the power adapting apparatus supplies the AC power and the DC power to the main unit of the image forming apparatus, wherein AC power received by the DC power generator bypasses the protection circuit.

8. The image forming apparatus of claim 7, wherein the power adapting apparatus further comprises a protection circuit to block the input AC power from outputting to the AC power output terminal when the input AC power is abnormal.

9. The image forming apparatus of claim 8, wherein the power adapting apparatus further comprises:

an AC power output controller to control output of the AC power from the protection circuit.

10. The image forming apparatus of claim 9, wherein the AC power output controller is a fusing controller to control a fusing unit of the image forming apparatus using the AC power output from the protection circuit.

11. An image forming apparatus comprising:

a main unit to receive AC power and DC power to perform an image forming operation; and a power adapting apparatus spaced apart from the main unit comprising a DC power generator to receive input AC power and to generate DC power, a DC power output terminal to output the DC power, a fusing controller to control a fusing unit of the image forming apparatus using the input AC power, and an AC power output terminal to output the input AC power controlled by the fusing controller wherein the power adapting apparatus supplies the AC power and the DC power to the main unit of the image forming apparatus.

12. The image forming apparatus of claim 7, wherein the power adapting apparatus further comprises an AC-AC transformer to transform the voltage of the input AC power to the voltage of the AC power output through the AC power output terminal when the voltage of the input AC power is different from the voltage of AC power required by the AC power output terminal and outputs the input AC power without changing the voltage thereof when the voltage of the input AC power equals the voltage of the AC power output through the AC power output terminal.

13. An electronic apparatus comprising:

a main unit to receive AC power and DC power; and a power adapting apparatus spaced apart from the main unit comprising a DC power generator to receive input AC power and generate DC power, a DC power output terminal to output the DC power, an AC power output terminal to output the input AC power, and a protection circuit to block the input AC power from outputting to the AC power output terminal when the input AC power is abnormal, wherein the power adapting apparatus supplies the AC power and the DC power to the main unit of the electronic apparatus, wherein AC power received by the DC power generator bypasses the protection circuit.

14. The electronic apparatus of claim 13, wherein the power adapting apparatus further comprises:

a protection circuit to block the input AC power from being output to the AC power output terminal when the input AC power is abnormal.

15. The electronic apparatus of claim 14, wherein the power adapting apparatus further comprises:

an AC power output controller to control output of the AC power from the protection circuit.

16. The electronic apparatus of claim 13, wherein the power adapting apparatus further comprises:

an AC power output controller to control output of the input AC power.

17. The electronic apparatus of claim 13, further comprising:

an AC-AC transformer to transform the voltage of the input AC power to the voltage of the AC power output through the AC power output terminal when the voltage of the input AC power is different from the voltage of AC power required by the AC power output terminal and outputs the input AC power without changing the voltage thereof when the voltage of the input AC power equals the voltage of the AC power output through the AC power output terminal.

18. An electronic apparatus, comprising:

an image forming unit to receive AC power and DC power; and an external power adapting unit separated from the image forming unit with a switching mode power supply to convert received AC power to DC power and to output AC power to the image forming unit upon receipt of a signal from a fusing controller within the image forming unit while providing DC power also output to the image forming unit and a protection circuit to block AC power received by the external power adapting unit from outputting when the AC power is abnormal, wherein AC power received by the switching mode power supply bypasses the protection circuit.

19. The electronic apparatus of claim 18, wherein the AC power and DC power are provided to the image forming unit separately via AC and DC power output terminals within the external power adapting unit.

20. The electronic apparatus of claim 18, wherein the image forming unit further comprises:

a buffer circuit to block AC power when the received AC power is abnormal.

21. A method of supplying power to an electronic apparatus, the method comprising:

inputting AC power into a power source externally connected to a central unit of the electronic apparatus;

converting AC power into DC power within the power source;

outputting AC power upon receipt of a control signal from a fusing controller within the central unit while providing DC power also output from the power source into the central unit; and blocking the input AC power from outputting when the input AC power is abnormal with a protection circuit, wherein the power source is spaced apart from the central unit, wherein the AC power converted into DC power bypasses the protection circuit.

* * * * *